US005613551A

United States Patent [19]

Rhodes

[11] Patent Number: 5,613,551

[45] Date of Patent: Mar. 25, 1997

[54] RADIATOR ASSEMBLY

[75] Inventor: Wayne A. Rhodes, Luray, Tenn.

[73] Assignee: Touchstone, Inc., Jackson, Tenn.

[21] Appl. No.: 574,210

[22] Filed: Dec. 18, 1995

[51] Int. Cl.[6] ..... F28F 7/00

[52] U.S. Cl. ..... 165/82; 165/149; 165/DIG. 55; 165/DIG. 469

[58] Field of Search ..... 165/149, 81, 82

[56] References Cited

U.S. PATENT DOCUMENTS 3,165,151 1/1965 Astrup et al. ..... 165/149 X
3,627,035 12/1971 Astrup ..... 165/82
4,619,313 10/1986 Rhodes et al. ..... 165/149 X

*Primary Examiner*—Leonard R. Leo
*Attorney, Agent, or Firm*—Head, Johnson & Kachigian

[57] ABSTRACT

An improved radiator assembly for supporting a cooling core has first and second push pads positioned contiguous to the opposite sides of the cooling core. The push pads have spaced apart slots therein. First and second side rails are positioned contiguous to the first and second push pads. The side rails have spaced apart tabs that extend within the push pad slots. The slots are of greater longitudinal dimension than the tabs thereby permitting the push pads to move longitudinally relative to the side rails. A plurality of tie rods extend between the side rails to hold the side rails and thereby the radiator assembly together.

7 Claims, 5 Drawing Sheets

RADIATOR ASSEMBLY

REFERENCE TO PENDING APPLICATION

This application is not related to any pending applications.

REFERENCE TO MICRO-FICHE APPENDIX

This application is not referenced in any microfiche appendix.

BACKGROUND OF THE INVENTION

This invention relates to an improved radiator assembly for supporting a cooling core of a radiator. A cooling core is typically formed of tubes, either flat or round, that span between a pair of header plates wherein the opposite ends of the tubes are bonded. The cooling core must be supported within side frames and the side frames need to be arranged so as to allow expansion and contraction of the core. It is therefore a basic object of this invention to provide an improved radiator assembly formed of a core and a frame for holding the core which allows the core to contract and expand within the frame.

BRIEF SUMMARY OF THE INVENTION

An improved radiator assembly is formed of a cooling core and a frame assembly. It is a function of the frame assembly to support and hold the cooling core in a correct position and to resist forces applied to the cooling core when the radiator assembly is utilized on mobile equipment such as trains, trucks, tractors, boats, ships and so forth.

The frame includes a first and second push pad positioned contiguous to the cooling core first and second sides respectively. Each of the first and second push pads may be of a single piece of metal or, in the preferred embodiment, each of the first and second push pads includes an upper and a lower portion. The push pads have spaced apart slots therein.

First and second side rails are positioned contiguous to the first and second push pads respectively.

Spaced apart tabs are affixed to and extend from the side rails, the tabs being received in the push pad slots. The slots have longitudinal dimensions greater than that of the tabs to thereby permit the push pads to move with respect to the tabs and thus, with respect to the side rails. The displaceability of the push pads allowing for elongation and contraction of the cooling core.

A plurality of spaced apart paralleled tie rods extend between the first and second side rails to secure and hold the side rails in fixed spacial relationship relative to each other. The frame thus encompasses the sides of the cooling core to retain the cooling core in a supported position while allowing contraction and expansion of the cooling core.

A better understanding of the invention will be obtained from the following description of the preferred embodiments taken in conjunction with the attached drawings.

DETAILED DESCRIPTION OF THE PREFERRED EMBODIMENTS

Figure 1:
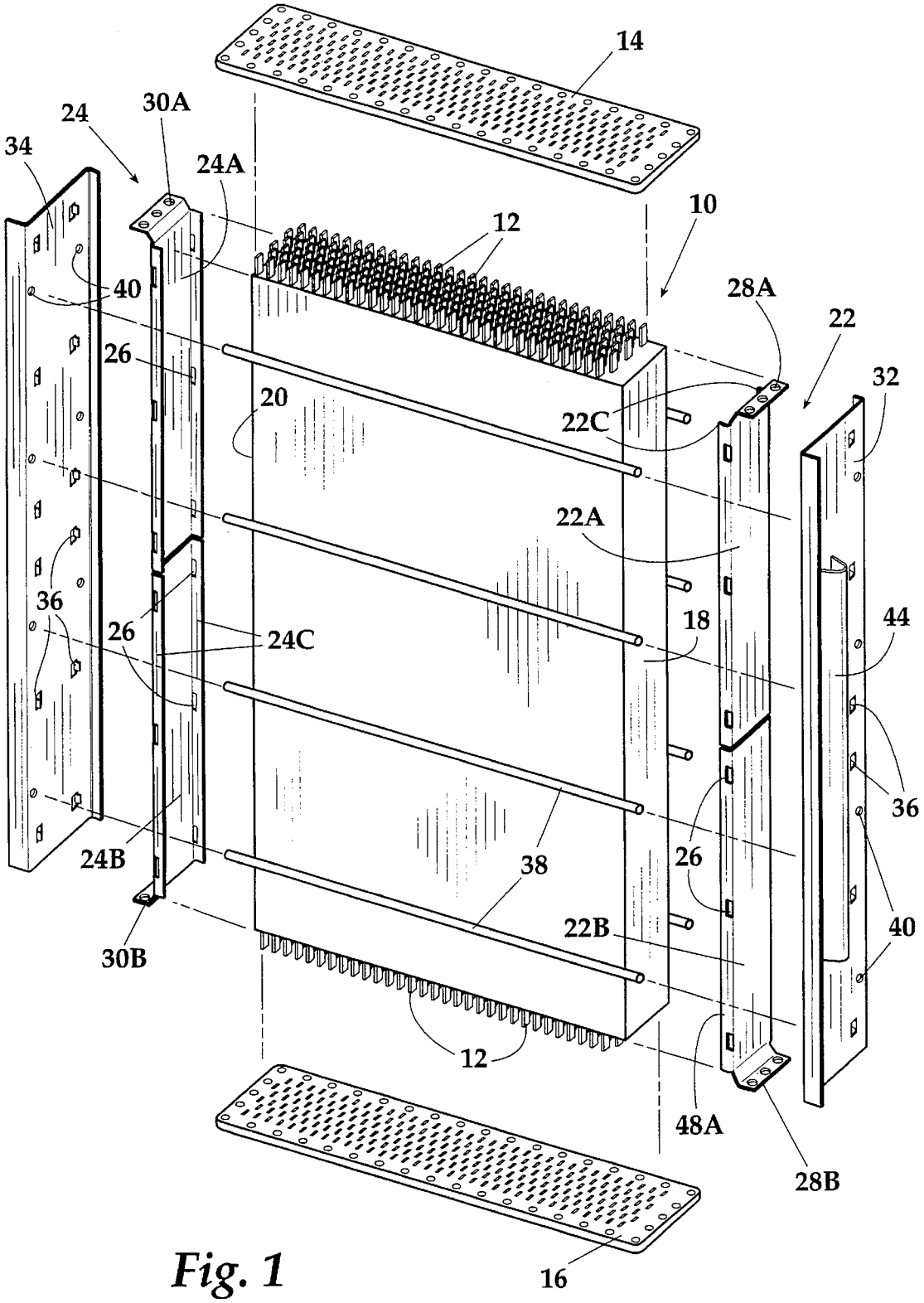
FIG. 1 is an exploded view of the basic component making up the improved radiator assembly.

Referring to the drawings and first to FIG. 1, the basic components of the improved radiator assembly are illustrated. A cooling core is indicated generally by the numeral 10. Core 10 consists of a large number of closely spaced tubes 12 that are supported at their upper ends by a top header 14 and at their lower ends by a bottom header 16. Core 10 has a first side wall 18 and a second side wall 20. The purpose of the invention is to provide an improved framework for supporting core 10 in a secure manner but in a way which will allow the core to expand and contract.

Positioned at core first side wall 18 is a first push pad generally indicated by the numeral 22. Push pad 22 is preferably in the form of an upper portion 22A and lower portion 22B. In like manner, second side wall 20 of core 10 is contacted by a second push pad 24 in the form of an upper portion 24A and lower portion 24B. Push pads 22 and 24 each have a plurality of spaced apart slots 26 therein. Further, first push pad 22 has an upper integral gusset 28A and lower gusset 28B. In like manner, second push pad 24 has an upper integral gusset 30A and lower gusset 30B.

Positioned exteriorly of first push pad 22 is first side rail 32, and contiguous to the second push pad 24 is a second side rail 34. Side rails 32 and 34 each have spaced apart tabs 36 extending therefrom.

Figure 2:
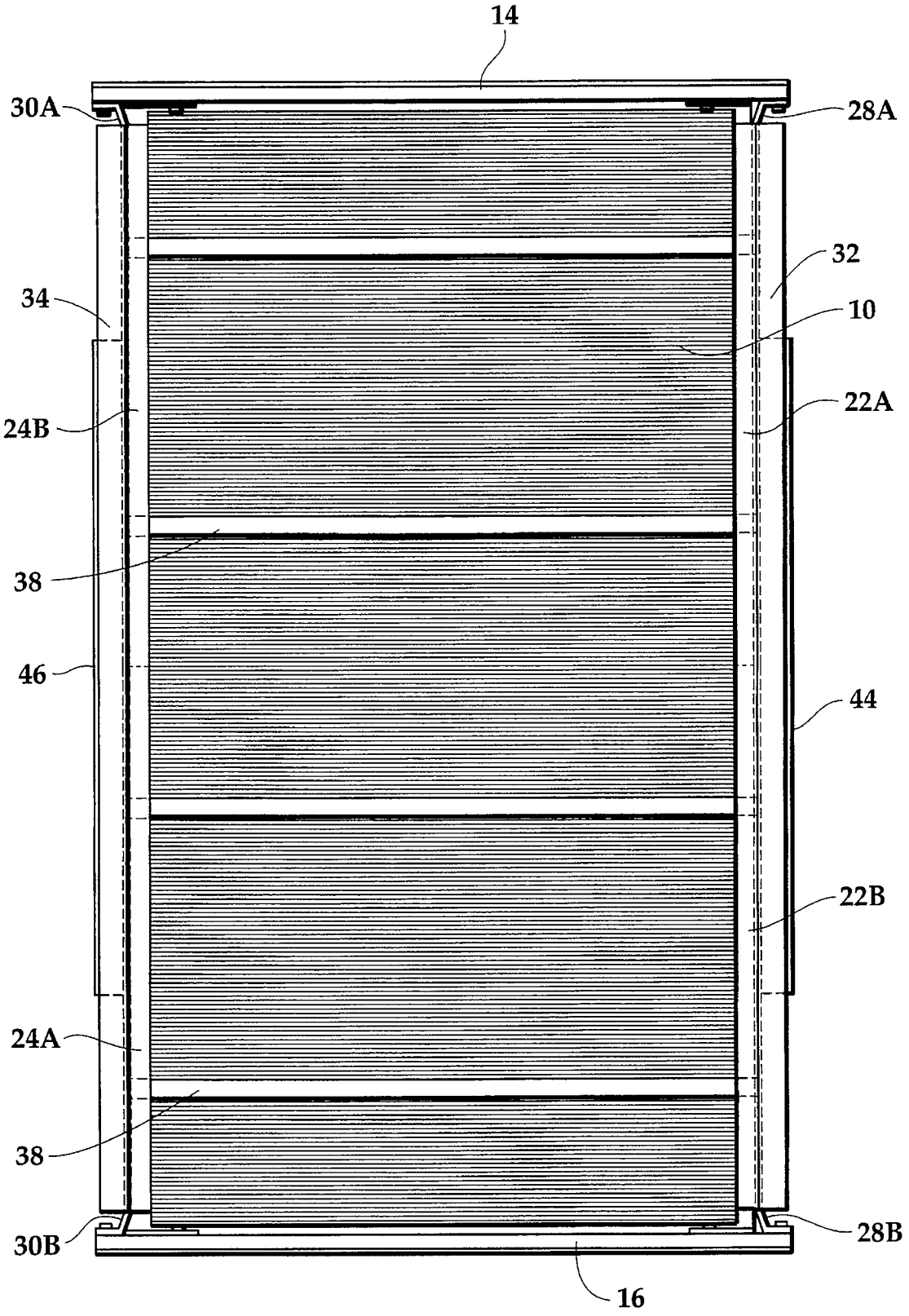
FIG. 2 is an elevational front view of the radiator assembly.

FIG. 2 shows the frame as it is assembled around core 10. Side rail upper gussets 28A and 30A are secured to top header 14 and lower gussets 28B and 30B are secured to bottom header 16.

To retain side rails 32 and 34 together, a plurality of spaced apart paralleled tie rods 38 are employed. The opposed ends of tie rods 38 extend through openings 40 in side rails 32 and 34.

As shown in FIG. 1, side rail 32 has a stiffener 44 welded to it. In like manner, second side rail 34 has a stiffener 46 that is seen in FIG. 2.

Figure 3:
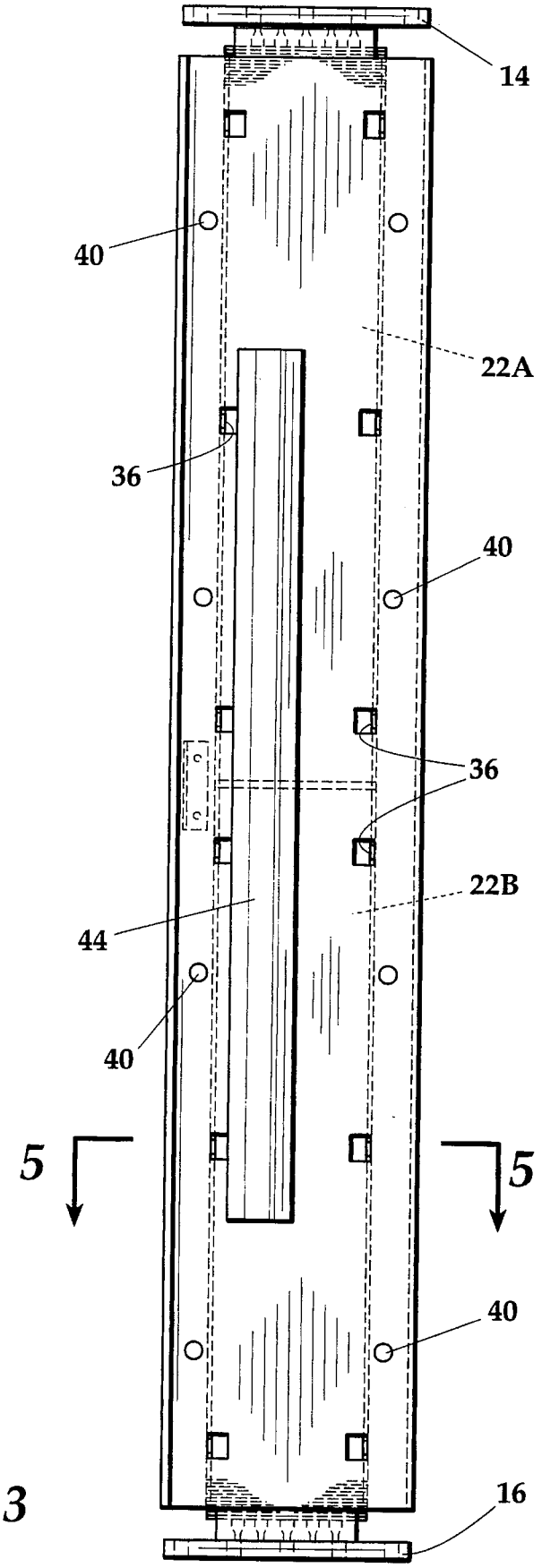
FIG. 3 is an elevational side view of the radiator assembly of FIG. 2.

FIG. 3 is an external elevational side view of the assembly of FIG. 2. FIG. 3 does not show the retainers that are secured to the ends of the tie rods nor the tie rods themselves but shows the openings 40 through which tie rods are received.

Figure 5:
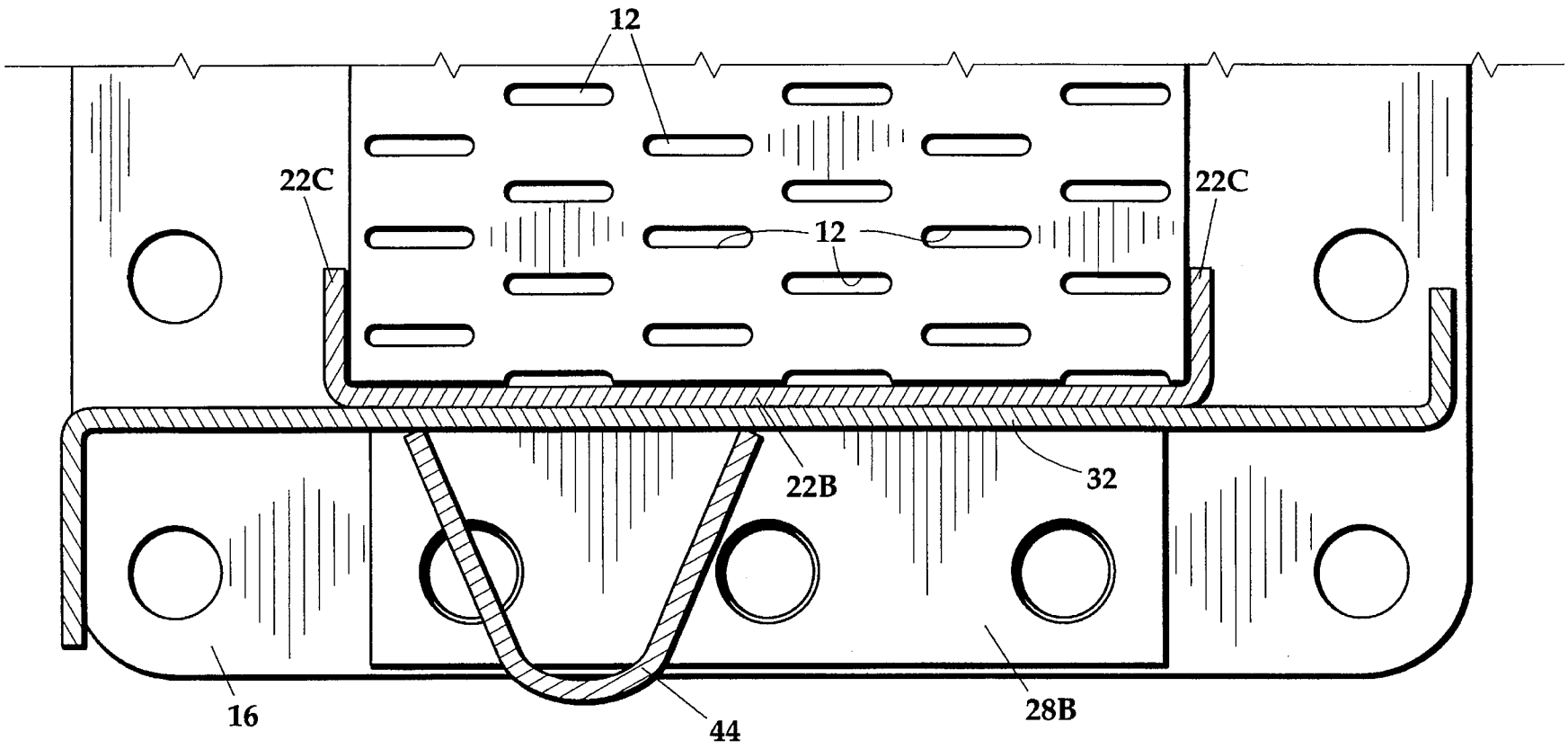
FIG. 5 is an enlarged partial cross-sectional view of the improved radiator assembly as taken along the line 5—5 of FIG. 3.

FIG. 5 is a cross-sectional view showing the relationship of the components as assembled.

As seen in FIG. 1, but better illustrated in FIG. 5, first push pad lower portion 22B has integrally opposed inwardly extending lip portions 22C. In like manner, second push pad 24 has integrally extending parallel lip portions 24C so that thus the push pads are essentially shallow channels with integral gussets at the upper and lower ends.

Figure 6:
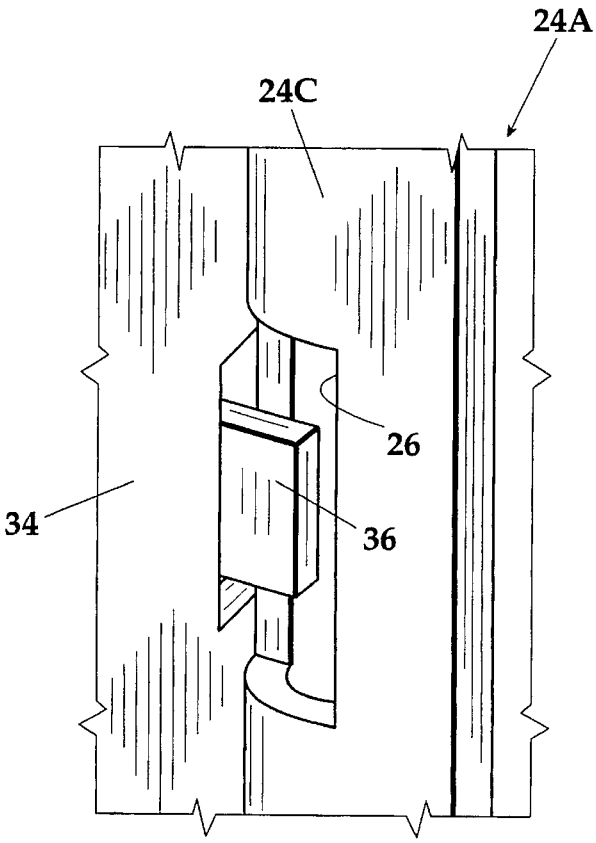
FIG. 6 is an enlarged fragmentary view taken at position 6 of FIG. 4 showing greater detail of the relationship between a side rail and a tab extending therefrom and a slot in a push pad to show how the tab fits in a push pad slot to allow for elongation and contraction of a cooling core.
Figure 4:
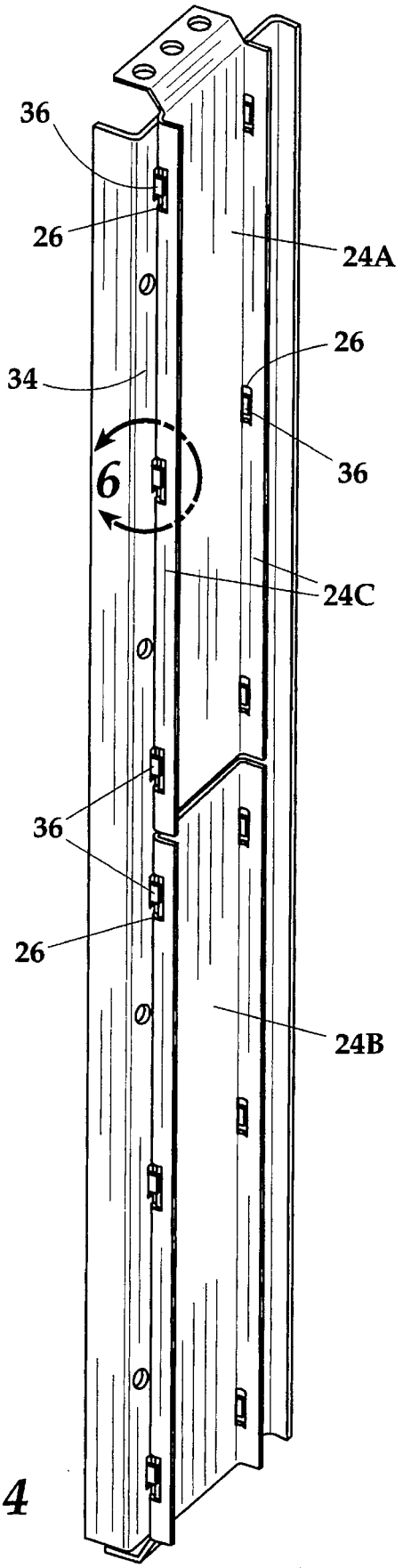
FIG. 4 is an isometric view of a push pad and side rail positioned adjacent to each other to show the relationship of the tabs extending from the side rail and the slots formed in the push pad.

FIG. 4 shows the relationship between second side rail 34 and second push pad upper portion 24A and lower portion 24B. Tabs 36 extend from second push plate 34, the tabs being received in slots 26 in second push pad upper and lower portions 24A and 24B. As best shown in the detailed view of FIG. 6, slots 26 are preferably formed in alignment with or co-planar with the push pad lip portions such as in the lip portion 24C in second push pad upper portion 24A.

The interrelation between side wall tabs 36 and push pad recesses 26 serves to retain the push pads in centered position with respect to the side rails. At the same time, since slots 26 are longitudinally longer than the height of tabs 36, the push pads are free to move relative to the side rails. It is the nature of cooling coils to expand and contract in response to temperature changes. Since the push pads are secured to the top and bottom headers, the push pads must be free to move with the headers. The push pads maintain a sliding relationship with the side rails so that they maintain the cooling core in proper position between the side rails but in a way that permits expansion and contraction of the cooling core without transferring such expansion and contraction to the side rails.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An improved radiator assembly comprising:

a cooling core having first and second sides;

first and second push pads positioned contiguous to said cooling core first and second sides respectively, the push pads having spaced slots therein;

first and second side rails positioned contiguous to said first and second push pads respectively, the side rails having spaced apart tabs extending therefrom, the tabs being received in said push pad slots, the dimension of said slots permitting said tabs to be moveable within said slots whereby said push pads are displaceable relative to said side rails to permit elongation and contraction of said cooling core; and means to hold said side rails together.

2. An improved radiator assembly according to claim 1 wherein said means to hold said side rails together comprising a plurality of spaced apart, paralleled tie rods, each tie rod having means at a first end thereof to attach to said first side rail and means at a second end thereof to attach to said second side rail.

3. An improved radiator assembly according to claim 1 wherein each of said first and second push pads is formed of separate upper and lower portions whereby the upper and lower portions are displaceable relative to each other.

4. An improved radiator assembly for encompassing a cooling core having first and second sides, comprising:

first and second push pads each having an upper section and a lower section, each section of each push pad having a central generally flat portion and opposed paralleled lip portions integrally extending normally of said central portion, each push pad section having spaced apart slots adjacent said lip portions, said push pads being positioned with said lip portions extending towards each other and adaptable to receive a cooling core therebetween;

first and second side rails positioned contiguous to said first and second push pads, the side rails having spaced apart tabs extending therefrom, the tabs being received in said push pad slots, the slots being dimensioned to permit limited displacement of said push pads with respect to said side rails; and means to retain said side rails with respect to each other.

5. An improved radiator assembly according to claim 4 wherein said slots formed in said push pads are substantially coincident with said push pad lip portions whereby said tabs extending from said side rails are substantially co-planar with said push pad lip portions.

6. An improved radiator assembly according to claim 5 wherein said means to hold said side rails together comprising a plurality of spaced apart, paralleled tie rods, each tie rod having means at a first end thereof to attach to said first side rail and means at a second end thereof to attach to said second side rail.

7. An improved radiator assembly comprising:

a cooling core having first and second sides;

first and second push pads positioned contiguous to said cooling core first and second sides respectively, the push pads having spaced slots therein;

first and second side rails positioned contiguous to said first and second push pads respectively, the side rails having spaced apart tabs extending therefrom, the tabs being received in said push pad slots, the dimension of said slots permitting said tabs to be moveable within said slots whereby said push pads are displaceable relative to said side rails to permit elongation and contraction of said cooling core;

wherein each of said push pads is formed of a central generally flat portion and integral opposed lip portions extending normal to said flat portion and wherein said slots formed in said push pads are substantially coincident with said lip portions whereby said tabs extending from said side rails are substantially co-planar with said lip portions; and means to hold said side rails together.

* * * * *